United States Patent [19]

Barnett

[11] Patent Number: 4,563,373

[45] Date of Patent: Jan. 7, 1986

[54] ANIMATED HANGER FOR CLOTHES AND OTHER ARTICLES

[76] Inventor: Burton Barnett, 12592 Martha Ann Dr., Rossmoor, Calif. 90720

[21] Appl. No.: 465,812

[22] Filed: Apr. 11, 1983

[51] Int. Cl.[4] ..... A63H 3/00; A63H 11/04

[52] U.S. Cl. ..... 428/16; 40/322; 223/85; 248/DIG. 8; 446/73

[58] Field of Search ..... 428/16, 28, 913.3; D6/248; 2/271; 223/85; 40/322; 46/116; 434/238; 248/DIG. 8

[56] References Cited

U.S. PATENT DOCUMENTS

| | | | |
|---|---|---|---|
| D. 168,912 | 2/1953 | Schaefer | D6/248 |
| 1,286,595 | 12/1918 | Jacobs | 223/85 |
| 1,763,686 | 6/1930 | Campana | 40/322 X |
| 2,710,489 | 6/1955 | Myers, Jr. | 46/116 X |
| 3,126,237 | 3/1964 | Kirk | 223/85 X |
| 3,205,614 | 9/1965 | Brosk | 446/73 |
| 3,392,891 | 7/1968 | Gingher | 223/85 |
| 3,475,852 | 11/1969 | Brosk | 46/116 |
| 3,758,974 | 9/1973 | Malmer | 40/322 |
| 3,978,601 | 9/1976 | Catron | 40/322 |
| 3,986,696 | 10/1976 | Malmer | 46/116 X |
| 4,083,742 | 4/1978 | Sugimoto | 428/16 X |
| 4,245,486 | 1/1981 | Matsumoto et al. | 428/28 X |

*Primary Examiner*—Henry F. Epstein
*Attorney, Agent, or Firm*—Klein & Szekeres

[57] ABSTRACT

A device which is simply constructed so that when an article is placed on a hanger or hook which is a part of said device, a change in a comical face or initiation of other attention-getting features such as sound or light results and, therefore, serves as a means for encouraging the hanging up of said articles.

7 Claims, 3 Drawing Figures

ANIMATED HANGER FOR CLOTHES AND OTHER ARTICLES

BACKGROUND OF THE INVENTION

Promoting neatness in some people, particularly children who have not developed good habits, has proven to be difficult. There is a need for methods of creating "attention getting" results so that major emphasis can be placed on developing such personal habits as hanging up clothes and other personal articles. Currently, the only attention getting methods are complaints or parental scolding which have often proven ineffective. A method of incentivizing neatness is by providing a device that, upon the application of an article of clothing or other similar articles, results in a change of visual appearance of a face provided as part of the device (e.g. unhappy to smiling expression, eyes move, etc.) or initiates an attention getting feature (e.g. voice activates, wheels turn, balloon inflates, lights activate, etc.).

It is, therefore, an outstanding object of the invention to provide a change of an attention getting configuration upon placement of an article on a hanger or hook provided.

Another object of the present invention is that it can be equipped with a clothes hanger or mounted on the wall in the form of a wall plaque with a hook or other means for hanging articles.

It is another object of this invention to act as a functional and educational device to encourage neatness.

It is a still further object of this invention to provide a means for hanging multiple articles.

With these and other objects in view, as will be apparent to those skilled in the art, the invention resides in the combination of parts set forth in the specification and covered by the claim appended hereto.

SUMMARY OF THE INVENTION

In general, the invention consists of a decorative feature such as a face (clown's face, etc.) or other attention getting configuration to which is connected a hanger or hook by means of a spring, elastic element or lever so that when an article, such as clothing is placed on the hanger or hook, the weight of the article extends the spring or moves the lever so that a change of the visual appearance (e.g. expression on clown's face changes from frown to a smile) takes place.

BRIEF DESCRIPTION OF THE DRAWINGS

The character of the invention, however, may be best understood by reference to one of its structural forms as illustrated by the accompanying drawings, in which.

DESCRIPTION OF PREFERRED EMBODIMENT

Figure 1:
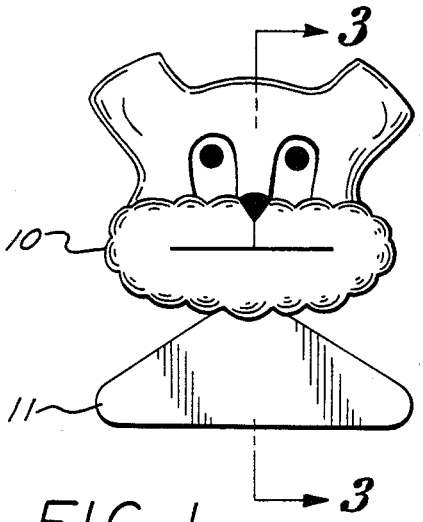
FIG. 1 is a frontal view of the device before it is activated by placing an article on the hanger.

Referring first to FIG. 1, the invention is shown to have an attention getting face, indicated by reference numeral 10, and a clothes hanger 11.

Figure 2:
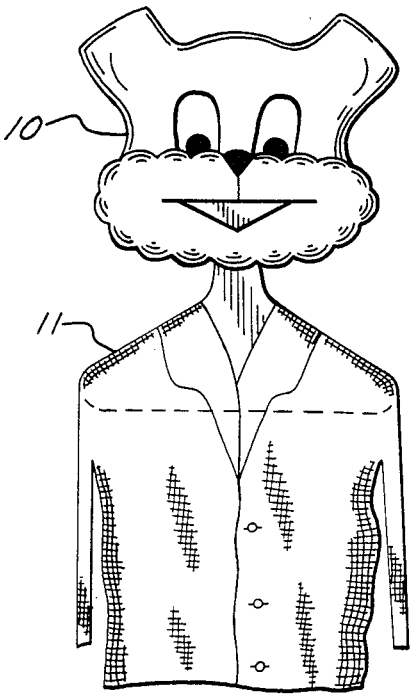
FIG. 2 is a frontal view of the device after it is activated by placing an article on the hanger.

As shown in FIG. 2, the change in the location of the eyes and the expression of the mouth of the attention getting face 10 occurs when an article is placed on the clothes hanger 11.

Figure 3:
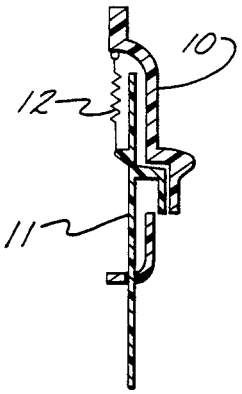
FIG. 3 is a vertical section of the device taken on line A—A of FIG. 1.

As evident in FIG. 3, the clothes hanger 11 is a separate part that extends upward and on which the eyes are illustrated, and said hanger part 11 has an appendage that causes the change in the appearance of the mouth. The placing of an article on the hanger 11 causes it to move down, moving the eyes down and exposing the appendage to the hanger part 11, resulting in a change of facial expression by giving a smiling appearance. The downward movement of the hanger 11 also extends the return spring 12, which upon removal of the article from the hanger causes the hanger part 11 to return to its original position, and thus also returning the expression on the face 10 to its original condition.

It is change of expression or activation of other attention getting configuration that incentivizes the hanging up of articles.

It is obvious that minor changes can be made in form and construction of the invention without departing from the spirit thereof. It is not, however, desired to confine the invention to the exact form herein shown and described, but it is desired to include all such as properly come within scope claimed.

The invention having been thus described, what is claimed as new, and desired to secure by Letters Patent is:

1. A garment hanging apparatus for providing a change in the expression of an animated figure when a garment is hung on the apparatus, the apparatus comprising:

a first member bearing the configuration of the animated figure, said first member having first and second openings, respectively in the place of each of the two eyes of the animated figure, and a third opening in the place of the mouth of the animated figure, the first member being adapted for being mounted to a wall or the like;

a second member mounted to the first member in a linearly sliding relationship behind the first member to occupy two extreme positions relative thereto, the first member including means for permitting linear motion of the second member relative to the first member, the second member bearing a pictorial representation of the two eyeballs of the animated figure, and having a tongue for the animated figure, the second member further having appendage means for accepting a garment hung on the appendage means, and spring means for normally positioning the second member into the first extreme position relative to the first member wherein the eyeballs are disposed in a first position to show through the first and second openings and wherein the tongue is substantially hidden from view behind the first member, the spring means being adapted to be overcome by the weight of a garment hung to the appendage means, whereby the weight of the garment causes the second member to linearly slide into the second extreme position relative to the first member, in said second extreme position the eyeballs occupying a second position to show through the first and second openings of the first member, and the tongue member protruding from the third opening in the second extreme position.

2. The garment hanging apparatus of claim 1, wherein the spring means comprise a spring.

3. The garment hanging apparatus of claim 1 wherein the third opening which defines the mouth of the animated figure is formed by two parallel disposed spaced plates included in the first member, and wherein in the second extreme position of the second member relative to the first member, the tongue is disposed extended, vertically downwardly between the two spaced plates.

4. A garment hanging apparatus configured as an animated figure and adapted for changing the facial expression of the animated figure when a garment is hung on the apparatus, the apparatus comprising:

a first member bearing the configuration of the animated figure, said first member having first and second openings, respectively, in the place of each of the two eyes of the animated figure, and a third opening in the place of the mouth of the animated figure;

a second member mounted behind the first member to the first member in a linearly sliding relationship thereto, the second member including a representation of two eyeballs of the animated figure and a plate configured as a tongue of the animated figure, the second member being adapted for linearly moving downwardly to the first member when a garment of sufficient weight is placed upon said second member, the second member being further adapted for occupying two extreme positions relative to the first member, in the first extreme position the eyeballs being disposed behind the first and second openings to show through said first and second openings in upper positions, and the plate of the tongue being substantially hidden from view behind the first member, in the second extreme position the eyeballs being disposed in the first and second openings to show through said first and second openings in lower positions, and the plate of the tongue being disposed extended through the third opening and exposed to view, and spring means mounted to the first member and the second member for normally holding the second member in the first extreme position, the spring means being adapted to be overcome by the weight when a garment is hung on the spring means.

5. The garment hanging apparatus of claim 4 wherein the spring means comprise a spring.

6. The garment hanging apparatus of claim 5 wherein the plate of the tongue of the animated figure is substantially vertically disposed.

7. The garment hanging apparatus of claim 6 wherein the first member includes two spaced, substantially vertically disposed plates having a slot between the spaced plates, the slot forming the third opening, and wherein in the second extreme position of the second member the plate of the tongue is extended downwardly through the slot.

* * * * *